United States Patent [19]

Nosaka

[11] 4,344,017

[45] Aug. 10, 1982

[54] CATHODE RAY TUBE USED AS LIGHT SOURCE

[75] Inventor: Eisyo Nosaka, Nagaokakyo, Japan

[73] Assignee: Mitsubishi Denki Kabushiki Kaisha, Tokyo, Japan

[21] Appl. No.: 147,544

[22] Filed: May 7, 1980

[30] Foreign Application Priority Data

May 8, 1979 [JP] Japan ..... 54-55918
Dec. 17, 1979 [JP] Japan ..... 54-175223[U]

[51] Int. Cl.[3] ..... H01J 29/46; H01J 29/56
[52] U.S. Cl. ..... 315/16; 313/449
[58] Field of Search ..... 313/396, 427, 428, 448, 313/449, 452, 460, 463, 467, 469, 481, 477 R, 495; 315/14, 15, 16

[56] References Cited

U.S. PATENT DOCUMENTS 2,367,130 1/1945 Klemperer ..... 313/449 X
3,189,784 6/1965 Fyler ..... 313/454 X
3,374,379 3/1968 Maruyama et al. ..... 313/448
3,417,199 12/1968 Yoshida et al. ..... 313/449 X
4,287,450 9/1981 Kawakami et al. ..... 313/449 X

FOREIGN PATENT DOCUMENTS 249037 5/1963 Australia ..... 313/448

*Primary Examiner*—Paul L. Gensler
*Attorney, Agent, or Firm*—Wenderoth, Lind & Ponack

[57] ABSTRACT

The disclosed cathode ray tube for use as a light source has an electron gun including a first, a second and third grid electrodes similar to conventional three electrode electron guns but the axial length of the second grid electrode is adjusted to form a bipotential electron lens with the third grid electrode. An electron beam emitted from a cathode electrode is focussed by the electron lens and then diverged until it reaches an associated phosphor screen. The phosphor screen is luminesced with a desired diameter by the diverged electron beam.

4 Claims, 11 Drawing Figures

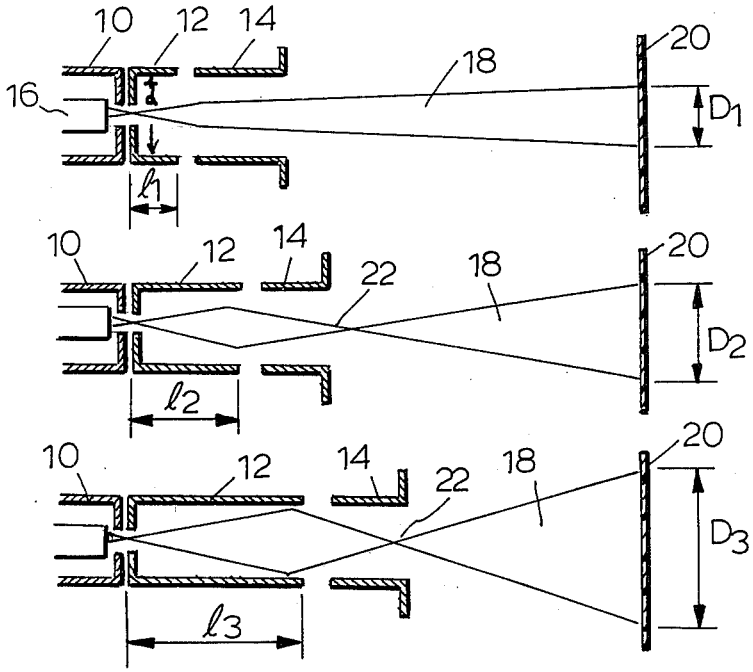
FIG. 3a
FIG. 3b
FIG. 3c
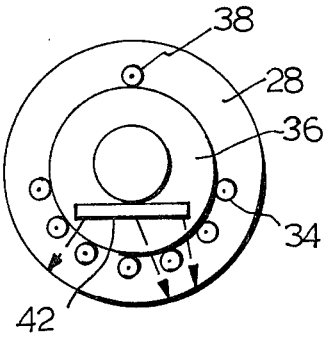
FIG. 7
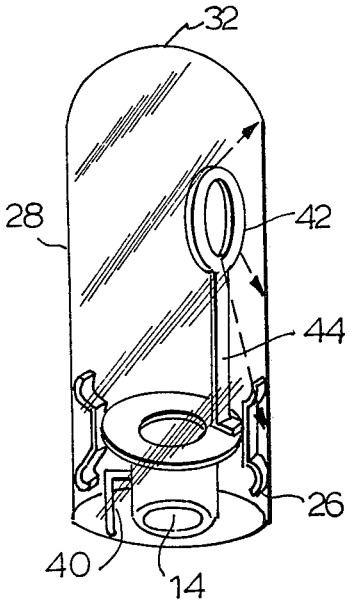
FIG. 8

CATHODE RAY TUBE USED AS LIGHT SOURCE

BACKGROUND OF THE INVENTION

This invention relates to a cathode ray tube for use as a light source.

Light sources for display purposes have previously been various types of incandescent lamps or monochromatic miniature cathode ray tubes. The incandescent lamps have unsatisfactory brightness, short lifetime and are difficult to maintain. Also the conventional type of monochromatic cathode ray tubes have comprised an electron gun disposed therein to emit an electron beam and a phosphor screen irradiated with the electron beam after the deflection thereof whereby the phosphor screen luminesces. This has resulted in the necessity of using a deflecting system for deflecting the electron beam and a complicated driving circuit. Accordingly, there has been the disadvantage that, with a multitude of such cathode ray tubes arranged in a predetermined pattern, it is very difficult to drive them simultaneously.

A conventional electron gun disposed in such a cathode ray tube has included a cathode electrode, a first cylindrical grid electrode, a second cylindrical grid electrode and a third cylindrical grid electrode, disposed in coaxial spaced relationship and supplied with respective voltages as desired. An electron beam emitted from the cathode electrode passes through a crossover point and then diverges toward the phosphor screen involved until it forms a circular luminescent spot thereon. The luminescent spot has a diameter which increases as the voltage applied to the phosphor screen decreases and vice versa. Even though the luminescent spot can be given the required diameter on the screen by decreasing the voltage, the brightness of the luminescent spot is too dark to permit the resulting cathode ray tube to be employed as a light source.

Also in order to maintain the interior of such a cathode ray tube under a high vacuum, a getter, for example barium has been required to be scattered therein. This has caused the barium to adhere to stem leads connected to the electron gun and to discharge thereacross resulting malfunction and unrequired luminescence which decreases the lifetime of the cathode ray tube used as a light source.

Accordingly it is an object of the present invention to provide a new and improved cathode ray tube for use as a light source having a high brightness characteristic.

It is another object of the present invention to provide a miniature cathode ray tube for use as a light source.

It is still another object of the present invention to provide a new and improved cathode ray tube for use as a light source for forming a luminescent spot having any desired diameter on a phosphor screen involved.

It is a different object of the present invention to prevent a cathode ray tube used as a light source from malfunctioning and luminescing unnecessarily.

SUMMARY OF THE INVENTION

According to one aspect thereof, the present invention provides a cathode ray tube for use as a light source comprising an electron gun formed of a cathode electrode for emitting an electron beam, a first grid electrode, a second grid electrode, and a third grid electrode, and a phosphor screen opposite to the electron gun and spaced therefrom, the third grid electrode being electrically connected to the phosphor screen, the second and third grid electrodes forming an electron lens for focussing the electron beam once before the electron beam reaches the phosphor screen, the phosphor screen luminescing due to the impingement thereon of the diverged electron beam.

Preferably the phosphor screen may be caused to luminesce with a desired diameter luminescent spot by adjusting the axial length of the second grid electrode while maintaining a constant ratio of the voltage applied to the second grid electrode to that applied to the third grid electrode.

According to another aspect thereof, the present invention provides a cathode ray tube for use as a light source as described in the preceding paragraph further comprising a plurality of stem leads for supplying voltages to the electron gun, one of which at a high voltage, and a getter disposed opposite to and offset from the one lead.

BRIEF DESCRIPTION OF THE DRAWINGS

The present invention will become more readily apparent from the following detailed description taken in conjunction with the accompanying drawings in which:

FIGS. 3A, 3B and 3C are fragmental schematic longitudinal sectional views of cathode ray tubes for use as light sources illustrating the relationship between the axial length of a second grid electrode of the three electrode electron gun and the diameter of a luminescent spot on the phosphor screen irradiated with an electron beam emitted from the electron gun and useful in explaining the fundamental principles of the present invention;

FIGS. 7 and 8 are respectively a plan and a perspective view of the arrangement shown in FIG. 6.

DESCRIPTION OF THE PREFERRED EMBODIMENTS

Figure 1A:
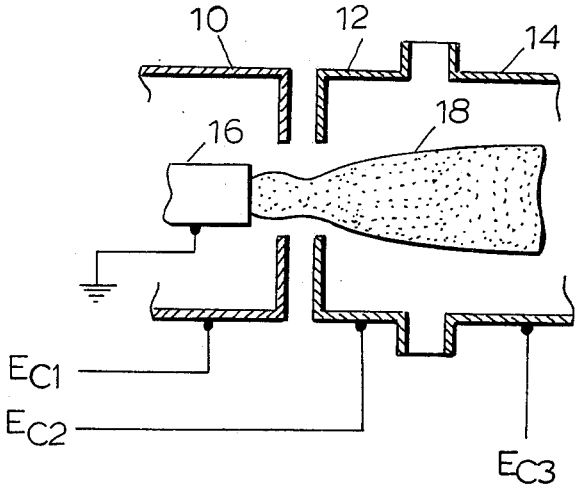
(PRIOR ART) FIG.1a
FIG. 1A is a schematic longitudinal sectional view, on an enlarged scale, of a conventional electron gun of a cathode ray tube used as a source of light.

Referring now to FIG. 1A, there is illustrated a conventional electron gun of a cathode ray tube for use as a light source. The arrangement illustrated is of the three electrode type tube comprising a first grid electrode 10, a second grid electrode 12 and a third grid electrode 14 disposed in spaced relationship in the named order and coaxial with an envelope for the cathode ray tube, although the envelope is not illustrated. The first grid electrode 10 is in the form of a hollow cylinder having an apertured end surface provided with a central aperture having a diameter of from 0.5 to 1 mm and opposite to and spaced from a cylindrical grounded cathode electrode 16 disposed coaxially within the first grid electrode 10. The second grid electrode 12 is also in the form of a hollow cylinder having an apertured end surface opposite to that of the first grid electrode 10 and provided with a central aperture substantially equal in diameter to that provided in the first electrode and axially aligned with the latter. The third grid electrode 14 is in the form of a hollow cylinder open at both ends. The opposite open ends of the second and third grid electrodes 12 and 14 respectively are in the form of cylindrical electrodes and form an electron lens for an electron beam 18 emitted from the cathode electrode 16, which is coated with a suitable material for emitting electrons.

The electron beam 18 emitted from the cathode electrode 16 is controlled by a voltage $E_{c1}$ applied to the first grid electrode 10 and accelerated by a voltage $E_{c2}$ applied to the second grid electrode 12. Then the electron beam 18 is further accelerated by a voltage $E_{c3}$ applied to the third grid electrode 14 until it reaches a phosphor screen 20 (see FIG. 1B) to cause the screen to emit luminescent light. In this case the phosphor screen 20 is put at the same potential as the third grid electrode 14 supplied with the voltage $E_{c3}$.

Figure 1B:
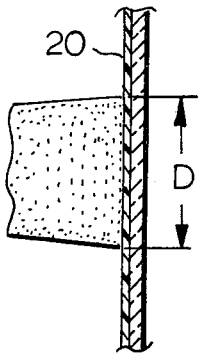
(PRIOR ART) FIG.1b
FIG. 1B is a fragmental longitudinal sectional view, on an enlarged scale, of a front face plate with a phosphor screen irradiated with an electron beam emitted from the electron gun shown in FIG. 1A and the adjacent portion thereof.

Under these circumstances, the voltage $E_{c1}$ on the first grid electrode 10 can be varied to change the current $I_K$ forming the electron beam 18. As shown in FIG. 1A, the electron beam 18 from the cathode electrode 16 passes through the aperture in the first grid electrode 10 and then a crossover point after which it enters the second grid electrode 12. Then the electron beam 18 is diverged under the control of the cylindrical electron lens formed of the second and third grid electrodes 12 and 14 respectively while it advances along a straight line toward the phosphor screen 20. When it reaches the phosphor screen 20, the electron beam 18 causes that portion of the phosphor screen 20 irradiated therewith to luminesce in a circular spot having a diameter D as shown in FIG. 1B.

Figure 2:
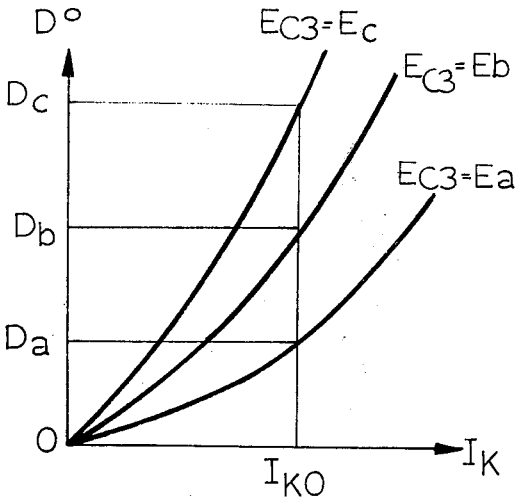
(PRIOR ART) FIG.2
FIG. 2 is a graph illustrating the relationship between the current of an electron beam emitted from the electron gun shown in FIG. 1A and the diameter of the luminescent spot formed on the phosphor screen shown in FIG. 1B due to the electron beam.

FIG. 2 illustrates the relationship between the current $I_K$ of the electron beam 18 plotted on the abscissa and the diameter D of the luminescent spot plotted on the ordinate. Since the distance between the phosphor screen 20 and the second grid electrode 14 affects the diameter D of the luminescent spot on the phosphor screen, the same is maintained at a constant magnitude. Also the voltage $E_{c2}$ is clamped to any desired magnitude. Under these circumstances, it is seen from FIG. 2 that, with the electron beam current $I_K$ equal to $I_{K0}$, the diameter D of the luminescent spot on the phosphor screen is changed to equal $D_a$, $D_b$ or $D_c$ when the voltage $E_{c2}$ remains constant and $E_{c3}=E_a$, $E_{c3}=E_b$ or $E_{c3}=E_c$ respectively where $E_a$ is greater than $E_b$ which is, in turn, greater than $E_c$.

From the foregoing it is apparent that a decrease in voltage $E_{c3}$ of the phosphor screen 20 causes an increase in diameter D of the luminescent spot and that the diameter D decreases with an increase in voltage $E_{c3}$. Therefore an increase in voltage $E_{c3}$ of the phosphor screen for the purpose of increasing the brightness of the luminescent spot is incompatible with an increase in diameter of the luminescent spot. Also where the beam current $I_K$ has a low magnitude, up to 50 microamperes, the luminescent spot will not have the required diameter even though the voltage of the phosphor screen is decreased.

The ratio $D/I_K$ of the diameter D of the luminescent spot to the beam current $I_K$ is determined by both the substance forming the phosphor screen and the voltage of the latter and it is required to impart to the phosphor screen a current density not larger than a permissible current density thereof. It is generally necessary to operate a cathode ray tube for use as a light source with a current density not larger than from 3 to 4 microamperes per square centimeter of the phosphor screen for continuous service and not larger than 10 microamperes per square centimeters at the peak for intermittent service.

From the foregoing and also from the graph of FIG. 2 it is seen that, even though the required diameter of the luminescent spot can be obtained by decreasing the voltage of the phosphor screen, the resulting cathode ray tubes can not be used as light sources because the voltage of the phosphor screen is too reduced and actually is not higher than 5 kilovolts whereby the luminescent spot becomes very dark.

Also it may be considered that, in order to provide the required diameter of the luminescent spot and an increased voltage of the phosphor screen to not less than 10 kilovolts, the distance between the phosphor screen and the associated electron gun is increased beyond the a desired magnitude. However this measure can be not put to practical use because the resulting cathode ray tube becomes too long.

Also cathode ray tubes of the type described above for use as light sources have been constructed so that the cylindrical glass tube having an outside diameter of 29 mm, for example, is coated on one end surface with a phosphor screen and has the electron gun disposed at the other end forming a stem to generate an electron beam which stem has extending therethrough and sealed therein a lead for supplying a high voltage to the phosphor screen, and a plurality of leads connected to the electron gun.

On the other hand, it has been required to scatter the getter into such cathode ray tubes in order to maintain the interior thereof under high vacuum as in general cathode ray tubes. At that time, the getter, for example, barium has stuck to leads extending through the stem. The barium stuck to the stem leads has caused undesired discharges among the leads and malfunction and unnecessary luminescence. This has resulted in a decrease in the lifetime of cathode ray tubes for use as light sources.

The present invention is based on the discovery that when an electron beam emitted from a cathode electrode of an electron gun is introduced into a three electrode system composed of a first, a second and a third grid electrode, the diameter of a luminescent spot formed on an associated phosphor screen can be varied at will by changing the length of the second grid electrode without decreasing the voltage applied to the phosphor screen.

The fundamental principles of the present invention will now be described in conjunction with FIGS. 3A, 3B and 3C and FIG. 4. In FIGS. 3A, 3B and 3C wherein like reference numerals designate the components identical or corresponding to those shown in FIGS. 1A and 1B there are illustrated three cathode ray tubes for use as light sources similar to the cathode ray tube shown in FIGS. 1A and 1B but including respective second grid electrodes having different axial lengths from one another while the tubes are identical in overall axial length to one another.

In FIG. 3A, the second grid electrode 12 has an axial length $l_1$ which is smaller than the inside diameter d thereof and the electron beam 18 emitted from the cathode electrode 16 is shown as passing through the crossover point located adjacent to the aperture on the second grid electrode 12 and then entering the latter while it is diverged. Thereafter the electron beam 18 passes through the third grid electrode 14 with the angle of divergence decreased until it reaches the phosphor screen 20 to form a circular luminescent spot with a diameter $D_1$ thereon.

In the arrangement of FIG. 3A, the second grid electrode 12 is supplied with a voltage $E_{c2}$ ranging from 50 to 100 volts while the third grid electrode 14 is supplied with a voltage $E_{c3}$ of about 10 kilovolts. Also the phosphor screen 20 has a voltage equal to that of the third grid electrode 14 as in the arrangement shown in FIGS. 1A and 1B. The voltage ratio N of the voltage $E_{c3}$ applied to the third grid electrode 14 to voltage $E_{c2}$ applied to the second grid electrode 12 provides an index indicating the refractive power of the electron lens formed of the second and third grid electrodes. When the voltages $E_{c2}$ and $E_{c3}$ have the valves as specified above respectively, the voltage ratio N ranges from 100 to 200. This means that the power of the electron lens may be considered to be very strong. As a result, the angle of divergence of the electron beam 18 passing through the electron lens decreases as shown in FIG. 3A and forms an under-focussed spot having a diameter $D_1$ on the phosphor screen 20.

In FIG. 3B, wherein the voltage conditions are the same as above, the axial length $l_2$ of the second grid electrode 12 is shown as exceeding the inside diameter d thereof. Under these circumstances, the second and third grid electrodes 12 and 14 respectively form a very strong bipotential electron lens with the voltage ratio N as specified above. Thus after having passed through the crossover point located adjacent the aperture in the second grid electrode 12, an electron beam 18 is focussed once at a focussing point 22 short of the phosphor screen 20 and is then diverged until it reaches the phosphor screen 20. At that time an overfocussed luminescent spot with a diameter $D_2$ is formed on the phosphor screen 20.

In FIG. 3B the electron beam 18 is shown as being focussed at the point 22 located on the outside of the third grid electrode 14 and spaced somewhat from the open end thereof nearer to the phosphor screen 20. The diameter $D_2$ is also larger than the diameter $D_1$ shown in FIG. 3A.

When the axial length of the second grid electrode 12 is further increased to $l_3$ as shown in FIG. 3C wherein the voltage conditions are also the same as above, a bipotential electron lens formed of the second and third grid electrodes 12 and 14 respectively has a long object distance and the image point calculated by the focussing expression is close to the electron lens. In FIG. 3C, the focus is shown as being located within the third grid electrode 16 adjacent to the open end thereof nearer to the phosphor screen 20. Therefore when the electron beam 18 is passing through this powerful bipotential electron lens 12-14, only the diameter thereof increases with respect to that of the lens. Accordingly the refractive power exerted on the electron beam 18 becomes large while at the same time the electron lens has increased aberrations. Thus the electron beam 18 is focussed at the focussing point 22 more remote from the phosphor screen 20 and simultaneously has an increased focussing angle. Under these circumstances, the electron beam 18 has an increased angle of divergence after having been focussed at the preceding point 22, and an over-focussed spot is formed, as a luminescent spot, on the phosphor screen 20 with a diameter $D_3$ larger than the diameter $D_2$ shown in FIG. 3B.

From the foregoing it is seen that, with the voltage ratio N between the second and third grid electrodes 12 and 14 respectively maintained constant, the diameter D of the luminescent spot on the phosphor screen can be changed by varying the axial length of the second grid electrode.

Figure 4:
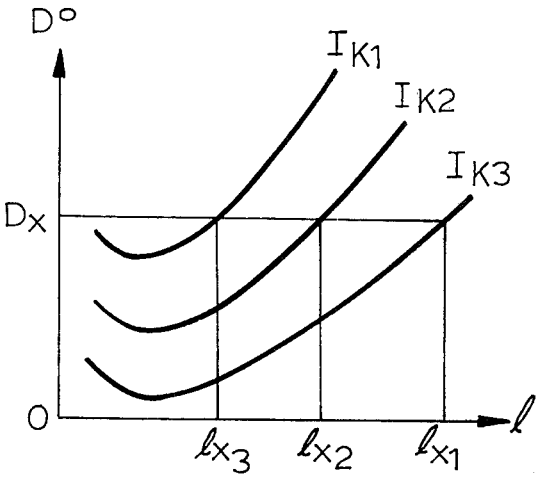
FIG. 4 is a graphical representation of the relationship between the axial length of the second grid electrode of the electron gun and the diameter of the luminescent spot on the phosphor screen illustrated in FIGS. 3A, 3B and 3C with an electron beam current taken as the parameter.

FIG. 4 shows the diameter D of the luminescent spot on the phosphor screen plotted on the ordinate against the axial length l of the second grid electrode on the abscissa with the electron beam current $I_K$ taken as the parameter. From FIG. 4 it is seen that for a given diameter $D_x$ of the luminescent spot formed on the phosphor screen, the second grid electrode has an axial length of $l_{x1}$, $l_{x2}$ or $l_{x3}$ for a magnitude $I_{K1}$, $I_{K2}$ or $I_{K3}$ of the electron beam current $I_K$. Therefore, for a given diameter of the luminescent spot, the desired axial length of the second grid electrode can be obtained from the graph of FIG. 4 after the magnitude of the electron beam current $I_K$ has been selected in accordance with the diameter and permissible current density of the phosphor screen.

From the foregoing it will readily be understood that, the desired luminescent spot can be provided on the phosphor screen by changing the axial length of the second grid electrode while the third grid electrode is maintained at a high voltage of not less than 10 kilovolts.

Figure 5:
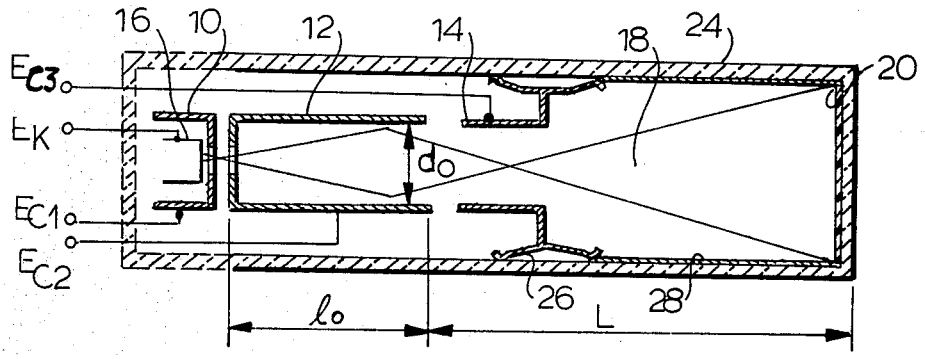
FIG. 5 is a schematic view of an embodiment of the cathode ray tube according to the present invention.

Referring now to FIG. 5, there is illustrated an embodiment of the cathode ray tube according to the present invention for use as a light source. The arrangement illustrated comprises an electron gun basically identical to that shown in any of FIGS. 3A, 3B and 3C and therefore in FIG. 1A. Accordingly like reference numerals have been employed to identify the components identical or corresponding to those shown in FIGS. 3A, 3B and 3C and therefore in FIG. 1A. The electron gun is coaxially disposed within an envelope 24 in the form of a hollow cylinder for a cathode ray tube and fixedly secured to a stem portion formed on one end, in this case the lefthand end of the envelope in the manner as described above in conjunction with FIG. 1A.

The envelope 14 is formed of any suitable glass and in this case has a uniform outside diameter of 29 millimeters. That end of the envelope 14 opposite to the electron gun 16-10-12-14 is closed to form a flat surface the inner side of which is coated with the phosphor screen 20. In the example illustrated, the phosphor screen is circular and has a diameter D of 23 millimeters.

Then an annular contact member 26 is disposed on the inner peripheral surface of the envelope 24 and is contacted on the central portion by a radially outward directed flange extending from that open end of the third grid electrode 14 which is toward the phosphor screen 20. Then a graphite film 28 is provided on that portion of the inner peripheral surface of the envelope 24 located between the phosphor screen 20 and that end of the contact member 26 which is toward the latter. Therefore the third grid electrode 14 is electrically connected to the phosphor screen 20 through the interconnected contact member 26 and the graphite film 28.

In FIG. 5, a plurality of leads are shown as extending through and being sealed in the stem portion and connected to the components of the electron gun.

The distance between the second grid electrode 12 and the phosphor screen 20 is desirably minimized and that distance in the example illustrated has been selected to be $L=11d_o$ where $d_o$ designates the inside diameter of the second grid electrode 12. Further the second grid electrode 12 has an axial length $l_o$ selected to be equal to $2\sim4d_o$ and preferably three and one half to four times the inside diameter thereof, i.e. $l_o=3.5\sim4d_o$. The phosphor screen 20 has a diameter D of $D=3\sim6d_o$ and in the example illustrated, is approximately equal to $4d_o$.

The arrangement of FIG. 5 is supplied with various voltages through the leads extending through the stem portion of the envelope 24 as described above. More specifically a cathode voltage $E_K$, a first grid voltage $E_{c1}$, a second grid voltage $E_{c2}$ and a third grid voltage $E_{c3}$ are applied to the cathode, first, second and third grid electrodes 16, 10, 12 and 14 respectively. In the example illustrated the cathode voltage $E_K$ serves as a driving voltage, and the voltage $E_{c1}$ has been set to be zero volts while the voltages $E_{c2}$ and $E_{c3}$ have been set to be 70 volts and 10 kilovolts respectively. Also the current of the electron beam has been set to have a peak magnitude of not higher than 30 microamperes in view of the permissible current density at the phosphor screen. This peak magnitude of the current corresponds to a current density of not higher than 7.2 microamperes per square centimeter.

The axial length of the second grid electrode 12 is preferably such that the phosphor screen 20 is irradiated throughout the entire area with the diverged electron beam 18 as shown in FIG. 5.

It has been found that the present invention can provide a miniature cathode ray tube for use as a light source having a high brightness. A multitude of such miniature cathode ray tubes can be arranged in a predetermined pattern to form effectively an electric display board. This is because the deflecting system for the cathode ray tubes can be eliminated and the driving circuit therefor can be greatly simplified.

According to another aspect thereof, the present invention contemplates eliminating the disadvantage originating from a getter as described above.

Figure 6:
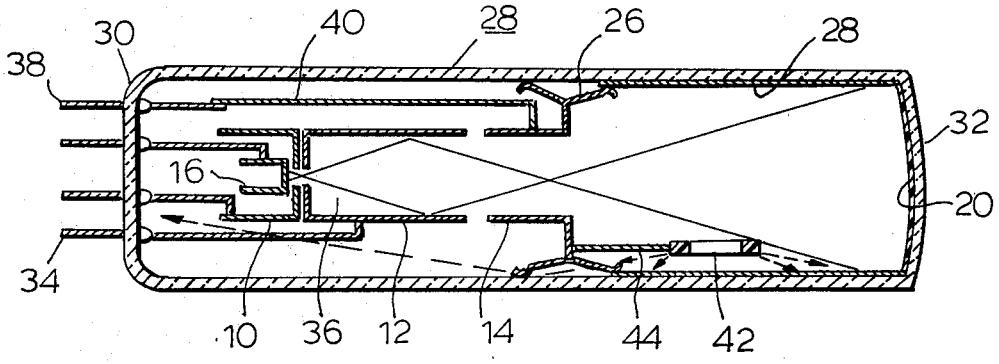
FIG. 6 is a longitudinal sectional view of a modification of the cathode ray tube of the present invention.

Referring now to FIGS. 6, 7 and 8 wherein like reference numerals designate components identical to those shown in FIG. 5 there is illustrated an embodiment of the present invention for preventing a getter from scattering toward a high voltage lead connected to an electron gun. The arrangement illustrated comprises a glass envelope 24 such as described above in conjunction with FIG. 5 including a stem portion 30 disposed at one end, in this case the lefthand end thereof, and a somewhat curved front face plate 32 closing the other or righthand end thereof. The front face plate 32 has the inner surface coated with the phosphor screen 20. On the other hand, a plurality of leads generally designated by the reference numeral 34 extend through the stem portion 30 and are located at substantially equal angular intervals in a circular arc as shown best in FIG. 7. Those leads 34 are connected to the cathode electrode 16, the first grid electrode 10, the second grid electrode 12 and others. Those electrodes along with the third grid electrode 14 form an electron gun generally designated by the reference numeral 36 as in the arrangement of FIG. 5. Another lead 38 having applied thereto a high voltage on the order of 10 kilovolts also extends through the stem portion 30 on the opposite side from and spaced from the leads 34 as shown in FIG. 7 and is connected to the third grid electrode 14 through a connecting lead 40 (see FIG. 6). The leads 34 and 38 serve to supply voltages to the components of the electron gun 36 while at the same time supporting the electron gun 36.

As in the arrangement of FIG. 6, the interconnected contact member 26 and graphite film 28 connect the third grid electrode 14 to the phosphor screen 20.

Also as shown best in FIG. 8, a getter 42 in the form of a circular annulus is disposed within the envelope 24 adjacent to the inner surface thereof by having a supporting member 44 connected between the annulus and that portion of the radially outward directed flange of the third grid electrode 14 facing the phosphor screen 20 so as to be opposite to and staggered from the connecting lead 40 connected to the high voltage lead 38.

As will be understood, the arrangement shown in FIGS. 6 through 8 can be externally subjected to high frequency heating in order to scatter the getter 42 to form a getter film thereon. At that time, the getter 42 is prevented from being directly scattered toward the high voltage lead 38–40 because the getter 42 has been disposed as described above. The getter 42 is scattered as shown by the arrows extending therefrom in FIGS. 6, 7 and 8 and a secondary component thereof is reflected from the inner surface of the envelope 24 as shown by the arrow in FIG. 6 but the same is shielded by the electron gun 36. This results in a satisfactory decrease in amount of the barium scattered adjacent to the high voltage lead 40 and therefore in discharges being prevented from occurring across the high voltage lead 38 and the leads 34. Accordingly, the arrangement shown in FIGS. 6, 7 and 8 ensures that, as a light source, the unnecessary luminescence and malfunction can be eliminated.

While the present invention has been illustrated and described in conjunction with a few preferred embodiments thereof it is to be understood that numerous changes and modifications may be resorted to without departing from the spirit and scope of the present invention.

What is claimed is:

1. A cathode ray tube for use as a light source, comprising an electron gun formed of a cathode electrode for emitting an electron beam, a first grid electrode, a second grid electrode having an axial length greater than the inside diameter thereof, and a third grid electrode, and an envelope means enclosing said electron gun and grid electrodes and having a phosphor screen constituting one end of said envelope means opposed to said electron gun downstream of said grid electrodes, said third grid electrode being electrically connected to said phosphor screen, a first voltage supply means connected to said cathode electrode for causing said cathode to emit a current sufficient to cause said phosphor screen to luminesce with the desired luminescence, a further voltage supply means connected to said second and third grid electrodes for applying to said third grid electrode a voltage as high as possible for the desired luminescence of said screen and for applying to said second grid electrode a voltage substantially less than the voltage applied to said third grid electrode, the length of said second grid electrode being sufficient for, at the voltages of said second and third grid electrodes, forming with said third grid electrode an electron lens for focussing said electron beam one before said beam reaches said phosphor screen and then diverging said beam for just filling a predetermined area of said screen with the diverged beam at the desired luminescence.

2. A cathode ray tube as claimed in claim 1 in which said envelope means is a hollow cylindrical tube encircling said electron gun and having said phosphor screen constituting said one end thereof, said hollow cylindrical tube having a uniform outside diameter.

3. A cathode ray tube as claimed in claim 1 in which said further voltage supply means comprises means for supplying voltages to said second and third grid electrodes in a ratio of the voltage to said third grid electrode to the voltage to said second grid electrode in the range of 100 to 200, and the distance L between said second grid electrode and said phosphor screen is from about 9 to about $12d_o$ where $d_o$ is the inside diameter of the open end of said second grid electrode, and said phosphor screen has a diameter $D=3\sim6d_o$ and said second grid electrode has an axial length $l=2\sim4d_o$.

4. A cathode ray tube as claimed in claim 1 further comprising a plurality of stem leads for supplying voltages to said electron gun, one of which is for carrying a high voltage, and a getter disposed in said envelope means opposite to and offset from said one lead.

* * * * *